US006457195B1

(12) United States Patent
Holste

(10) Patent No.: US 6,457,195 B1
(45) Date of Patent: Oct. 1, 2002

(54) HEAD AND NECK SUPPORT

(76) Inventor: Patricia A. Holste, 4550 Crown Point Ave., Omaha, NE (US) 68104

( * ) Notice: Subject to any disclaimer, the term of this patent is extended or adjusted under 35 U.S.C. 154(b) by 0 days.

(21) Appl. No.: 09/844,944

(22) Filed: Apr. 27, 2001

(51) Int. Cl.[7] ..... A47G 9/10
(52) U.S. Cl. ..... 5/636; 5/640
(58) Field of Search ..... 5/638, 640, 643; 297/393; 128/845, 869; 602/17, 18

(56) References Cited

U.S. PATENT DOCUMENTS

| | | | | | |
|---|---|---|---|---|---|
| 1,510,187 | A | * | 9/1924 | Martin | 128/DIG. 23 |
| 1,567,931 | A | | 12/1925 | Epler | |
| 2,961,668 | A | | 11/1960 | Hayes | 5/337 |
| 3,008,464 | A | | 11/1961 | Atkins | 128/24 |
| 4,197,604 | A | * | 4/1980 | Nakamura | 446/72 |
| 4,204,529 | A | | 5/1980 | Cochrane | 128/75 |
| 4,236,264 | A | * | 12/1980 | Britzman | 297/393 |
| 4,617,691 | A | | 10/1986 | Monti et al. | 5/434 |
| 4,738,488 | A | | 4/1988 | Camelio | 297/393 |
| 4,870,705 | A | | 10/1989 | Higby et al. | 2/2 |
| 5,029,577 | A | * | 7/1991 | Sarkozi | 602/18 |
| D322,380 | S | | 12/1991 | El-Asir | D6/601 |
| 5,211,623 | A | * | 5/1993 | Sarkozi | 128/DIG. 23 |
| 5,261,134 | A | | 11/1993 | Matthews | 5/655 |
| 5,363,524 | A | | 11/1994 | Lang | 5/640 |
| 5,584,086 | A | | 12/1996 | Vanwinkle et al. | 5/644 |
| 5,708,998 | A | | 1/1998 | Torbik | 5/636 |
| D419,024 | S | | 1/2000 | Lenahan et al. | D6/601 |
| 6,052,848 | A | | 4/2000 | Kelly | 5/632 |
| 6,058,517 | A | * | 5/2000 | Hartunian | 2/468 |
| 6,088,854 | A | * | 7/2000 | Brownrigg | 5/632 |
| 6,161,239 | A | * | 12/2000 | Grazel | 5/655 |
| 6,266,832 | B1 | * | 7/2001 | Ezell | 297/219.12 |

* cited by examiner

*Primary Examiner*—Michael F. Trettel
(74) *Attorney, Agent, or Firm*—Thomte, Mazour & Niebergall; Shane M. Niebergall

(57) ABSTRACT

A pillow and method of using the same is presented for providing comfortable lateral, fore and aft support for an individual's head and neck while the individual rests in a seated, prone or supine position. The pillow is elongated and generally cylindrical so that it can be adapted to completely encircle the individual's neck. The pillow is comprised of elastically deformable materials can be secured around the individual's neck in a generally helical pattern, overlapping the ends of the pillow. The pillow is then tightened or loosened to adjust for fit and comfort. In another embodiment, the pillow is secured around the individual's neck by tying the ends around each other. The amount of head and neck support can be adjusted by increasing or decreasing the number of times that the pillow encircles the individual's neck.

4 Claims, 2 Drawing Sheets

HEAD AND NECK SUPPORT

BACKGROUND OF THE INVENTION

1. Field of the Invention

This invention relates to head and neck supports and more particularly to a pillow that is easily adapted to comfortably encircle the neck of an individual to provide lateral, fore and aft support for the individual in a sitting, prone or supine position.

2. Description of the Prior Art

Long distance travel has become a frequent occurrence for many people. Whether by plane, train or automobile, weary travelers are typically forced to rest and sleep in upright or partially reclined positions. However, sleeping in such positions permits the traveler's head to nod forward or from side to side, waking the traveler every few minutes. Not only is the traveler prevented from resting, but the traveler risks cramped or strained neck and back muscles as well. The travel industry has provided travelers with little more than a miniature rectangular pillow and a blanket for their comfort. However, no matter how the traveler positions the pillow and blanket; complete support of the traveler's head and neck is unlikely if not impossible.

Recognizing the need for an effective but portable head and neck support for travelers, the prior art has provided a number of unique pillows. U.S. Pat. No. Des. 322,380 teaches a generally C-shaped inflatable neck pillow having a pair of side "arms" for the lateral support of the user's head and neck. The arms are joined by a third arm, which appears to provide support for either the front or the back of the user's head and neck. Opposite the third arm is an opening disposed between the ends of the two side arms. While this opening appears to enable the user to wrap the side arms around the user's neck, it leaves one of the front or the back of the user's head and neck unsupported. U.S. Pat. No. Des. 419,024 also teaches a generally C-shaped neck cushion similar to that taught by U.S. Pat. No. Des. 322,380. However, due to its shape, this neck cushion also fails to address the need of head and neck support in all directions. The user must decide whether to support the front or back of his head and neck, but not both.

Other known head and neck support devices, such as neck braces or C-collars, support the user's head in each direction, unlike the prior art neck cushions. However, neck braces and C-collars virtually immobilize the user's head, making them uncomfortable and obtrusive. Many users logically find it difficult to relax when they are unable to turn their heads from side to side when necessary. Clearly, such extreme support tends to cause restless discomfort and cramping similar to that caused from using no support device at all.

Accordingly, there is a need for an improved pillow that is light-weight, comfortable, and provides adequate lateral, fore and aft support for the user's head and neck while resting in a sitting, prone or supine position.

SUMMARY OF THE INVENTION

A method and apparatus provides comfortable lateral, fore and aft support for a user's head and neck while resting in a sitting, prone or supine position. The apparatus comprises an elongated generally cylindrical pillow that comfortably encircles the user's neck while positioned between the user's shoulders and the lower portions of the user's head. The pillow is comprised of a non-allergenic, elastically deformable fill material that is covered with one of an infinite number of decorative fabrics that are generally known to be comfortable and non-reactive to the user's skin. Both the fill material and the fabric are durable and capable of being laundered to provide a virtually unlimited number of uses for one or more users.

The pillow is easily adapted to support the user's head and neck in all directions simultaneously. Positioning the pillow around the user's neck provides lateral support between the user's shoulders and head. It further provides support behind the user's head and under the user's chin. Accordingly, the pillow can be used by a user in nearly any position. Moreover, the pillow's elastically deformable nature allows it to be secured in several different manners. One preferred method of securing the pillow in place provides for the overlapping of the opposite ends of the pillow to form a helical shape around the user's neck. Another preferred method of securing the pillow is achieved by tying the ends of the pillow around the user's neck. These and other methods can be chosen by the user for the desired fit and level of support.

Therefore, a principal object of the invention is to provide a pillow for comfortably supporting the head and neck of an individual in a sitting, prone or supine position.

Still another object of the invention is to provide an elastically deformable pillow that is easily adapted to support an individual's head and neck by comfortably encircling the individual's neck.

Still another object of the invention is to provide an elastically deformable pillow for supporting an individual's head and neck that is lightweight and convenient for travel.

Still another object of the invention is to provide an elastically deformable pillow for supporting an individual's head and neck that is comprised of light-weight materials that are easily and inexpensively cleaned.

Still another object of the invention is to provide an elastically deformable pillow for supporting an individual's head and neck that is easily secured about the user's neck without the use of additional materials or securing means.

These and other objects will be apparent to those skilled in the art.

DESCRIPTION OF THE PREFERRED EMBODIMENT

Figure 1:
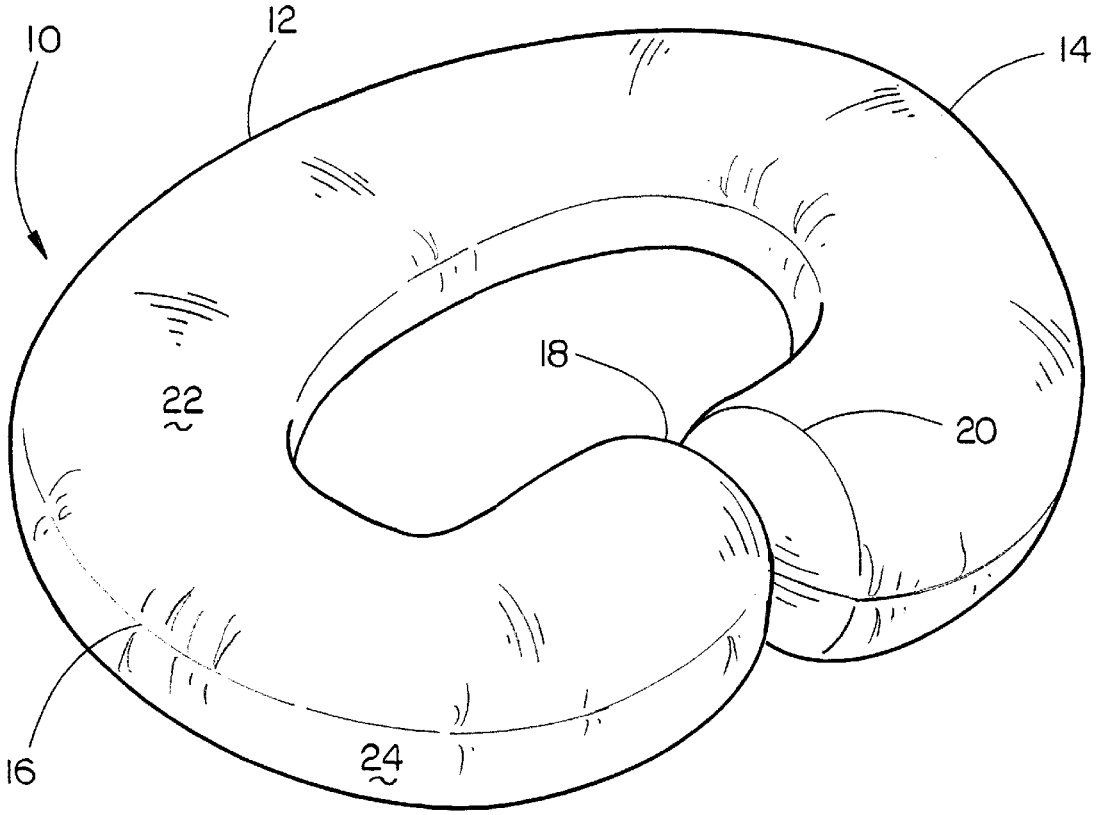
FIG. 1 is an isometric view of the invention in a "relaxed" position when it is not in use.

The numeral 10, shown in FIGS. 1–4, refers generally to the elongated, generally cylindrical, pillow for supporting a user's head and neck. FIG. 1 depicts the pillow 10 in its "relaxed" position when it is not in use. As depicted, the relaxed position is generally C-shaped, forming rear portion 12, side portions 14 and 16, and opposite ends 18 and 20.

In its preferred embodiment, the pillow 10 has a flexible cover that extends from the first end 18 to the second end 20 of the pillow. The cover has an exterior surface, which forms the upper surface 22 and lower surface 24 of the pillow 10, and an interior surface (not shown), which forms an interior cavity (not shown). Disposed within the interior cavity is a substantially homogeneous filling that is comprised of an elastically deformable fill material. Preferably, the fill material is comprised of a non-allergenic material, such as a polyester fill typically used in pillow cushions. The flexible cover is preferably comprised of an inexpensive, readily available material that will resist shrinkage when laundered such as a cotton/polyester blend. It is contemplated, however, that other known materials could be used for both the fill material (including various foam products, cotton batting, agricultural byproducts such as buckwheat hulls, and feathers) and the flexible cover (including flannel, twill, velvet, silk, etc.). It is further contemplated that the pillow 10 could be formed of an elastically deformable material that does not require a cover. Such a pillow could simply be comprised of foam, plastic, or other natural and artificial materials. Regardless of the materials used, it will be desired that the materials be capable of being laundered in order to keep the pillow 10 fresh and sanitary.

Figure 4:
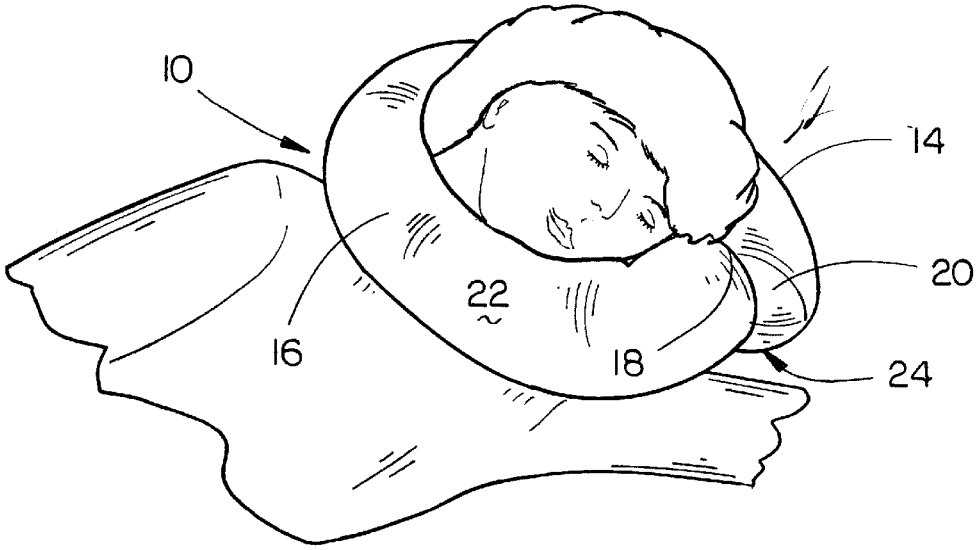
FIG. 4 is a side view of the invention in an "overlapping" use by an individual in the prone position.
Figure 3:
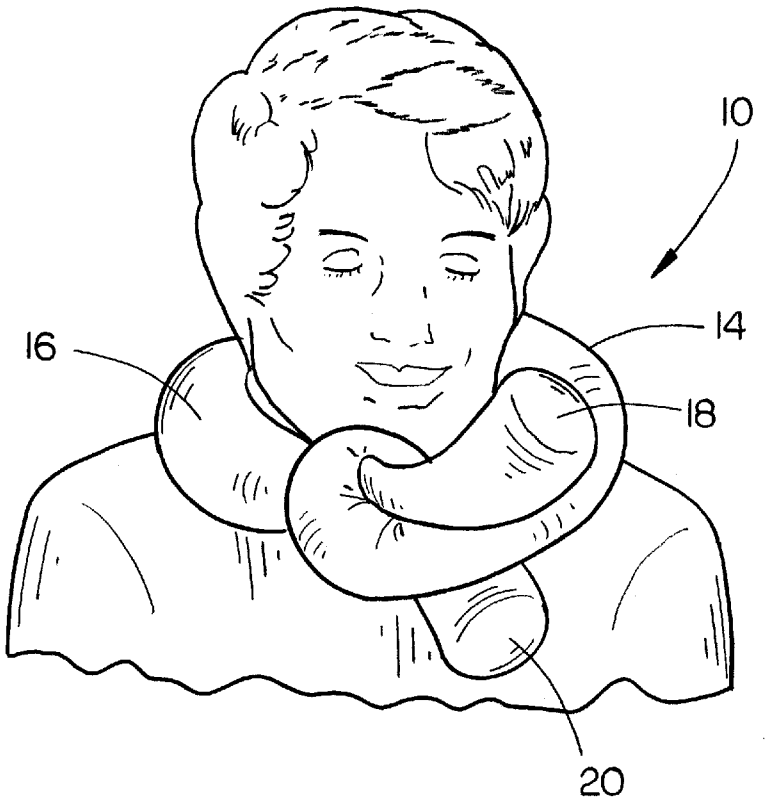
FIG. 3 is a front view of the invention in an alternate "knotted" use, providing lateral, fore and aft support to the user's head and neck.
Figure 2:
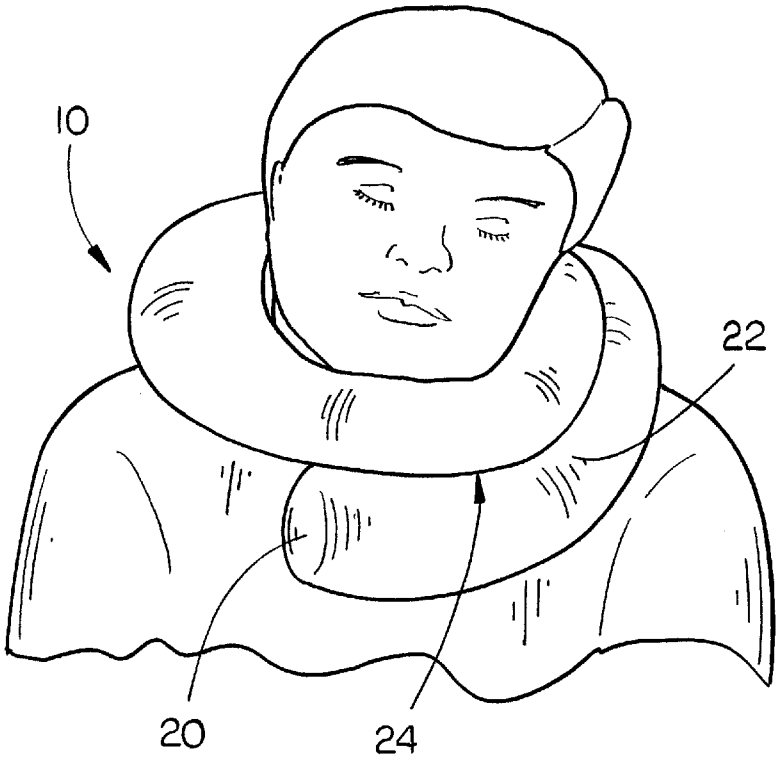
FIG. 2 is a front view of the invention in a preferred "overlapping" use, providing lateral, fore and aft support to the user's head and neck.

The pillow 10 is adapted to encircle the user's neck in a manner such as those depicted in FIGS. 2–4. The pillow 10 encircles the user's neck between the user's shoulders and the bottom of the user's head. The pillow 10 should be of sufficient diameter to rest closely adjacent the user's shoulders and provide lateral support to the sides of the user's head and neck. The diameter should further enable the pillow 10 to rest closely adjacent the top end of the user's chest and back areas while supporting the user's chin and the back of the user's head. In this position, the pillow 10 simultaneously supports the head and neck of the user in any direction generally transverse to the longitudinal axis of the user's neck.

The pillow 10 can be secured in its position around the user's neck in a number of preferred manners. FIG. 2 depicts one such preferred securing manner where the pillow 10 is coiled around the user's neck in a generally helical pattern, the upper surface 22 being placed closely adjacent the lower surface 24 in an "overlapping" manner. This positioning allows the user to tighten and loosen the coils of the pillow 10 according to the comfort needs to the user. The amount of head and neck support can be modified by simply increasing or decreasing the number of coils that extend vertically between the user's head and shoulders.

FIG. 3 depicts an individual, in a seated position, wearing the pillow 10 in a second preferred manner. As in FIG. 2, the pillow 10 encircles the user's neck. However, opposite ends 18 and 20 are adapted to be loosely tied around each other in the same manner that an individual would tie the ends of a scarf around their neck. Opposite ends 18 and 20 are then tightened by the user according to the user's desired level of comfort and support. To accommodate individuals having a larger than average diameter neck, the length of opposite ends 18 and 20 should be increased so that they may be adapted to tie comfortably around the users neck. As with the embodiment depicted in FIG. 2, the amount of head and neck support can be modified by increasing or decreasing the number of coils that extend vertically between the user's head and shoulders prior to tying opposite ends 18 and 20 around each other.

FIG. 4 depicts an individual wearing the pillow 10, secured in the coiled manner depicted in FIG. 2, while sleeping in the prone position. It is also contemplated that the individual could wear the pillow 10 in this position with the pillow being secured in the tying manner depicted in FIG. 2. Accordingly, the pillow 10 is easily adaptable to comfortably support the head and neck of an individual in any of a sitting, prone or supine position.

In the drawings and in the specification, there has been set forth preferred embodiments of the invention and although specific items are employed, these are used in a generic and descriptive sense only and not for purposes of limitation. Changes in the form and proportion of parts, as well as a substitution of equivalents, are contemplated, as circumstances may suggest or render expedient, without departing from the spirit or scope of the invention as further defined in the following claims.

Thus it can be seen that the invention accomplishes at least all of its stated objectives.

I claim:

1. A method of supporting the head and neck of an individual in a seated, prone or supine position, provided with a generally elongated, elastically deformable pillow having first and second ends, comprising the steps of:

completely encircling the individual's neck with said pillow to simultaneously provide lateral, fore and aft support for the user's head and neck; and comfortably securing the pillow in position around the individual's neck by overlapping said first and second ends so that the pillow coils generally upwardly from the user's shoulders towards the users head, forming a generally helical structure around the users neck.

2. The method of claim 1 further comprising the step of selectively adjusting the level of head and neck support to one or more sides of the individual's head and neck by adjusting the number of times that the pillow encircles the individual's neck.

3. A method of supporting the head and neck of an individual in a seated, prone or supine position, provided with a generally elongated, elastically deformable pillow having first and second ends, comprising the steps of:

completely encircling the individual's neck one or more times with said pillow to simultaneously provide lateral, fore and aft support for the user's head and neck; and comfortably securing the pillow in position around the individual's neck by tying said first and second ends around each other and tightening the same for fit and comfort.

4. The method of claim 3 further comprising the step of selectively adjusting the level of head and neck support to one or more sides of the individual's head and neck by adjusting the number of times that the pillow encircles the individual's neck.

* * * * *